US005384162A

United States Patent [19]

Takahashi et al.

[11] Patent Number: 5,384,162

[45] Date of Patent: Jan. 24, 1995

[54] METHOD AND APPARATUS FOR SIMULTANEOUSLY APPLYING A MULTI-LAYERED COATING AT HIGH SPEEDS

[75] Inventors: Shinsuke Takahashi; Norio Shibata, both of Kanagawa, Japan

[73] Assignee: Fuji Photo Film Co., Ltd., Kanagawa, Japan

[21] Appl. No.: 962,846

[22] Filed: Oct. 19, 1992

[30] Foreign Application Priority Data

Oct. 18, 1991 [JP] Japan ..... 3-297695

[51] Int. Cl.[6] ..... B05D 3/12; B05C 3/02

[52] U.S. Cl. ..... 427/356; 427/131; 118/411

[58] Field of Search ..... 427/131, 356; 118/411

[56] References Cited

U.S. PATENT DOCUMENTS

| | | | |
|---|---|---|---|
| 4,681,062 | 7/1987 | Shibata et al. | 118/410 |
| 4,854,262 | 8/1989 | Chino et al. | 118/411 |
| 5,069,934 | 12/1991 | Chino et al. | 427/131 |

FOREIGN PATENT DOCUMENTS

| | | |
|---|---|---|
| 0388818 | 9/1990 | European Pat. Off. . |
| 0437210 | 7/1991 | European Pat. Off. . |
| 3733031 | 4/1988 | Germany . |
| 1184072 | 7/1989 | Japan . |
| 1210072 | 8/1989 | Japan . |
| 1288364 | 11/1989 | Japan . |
| 2251265 | 10/1990 | Japan . |

*Primary Examiner*—Shrive Beck
*Assistant Examiner*—Katherine Bareford
*Attorney, Agent, or Firm*—Sughrue, Mion, Zinn, Macpeak & Seas

[57] ABSTRACT

A coating method and a coating apparatus which assure that an upper layer and a lower layer, each composed of a thin film, are excellently simultaneously coated on a web while forming a laminated structure without the appearance of strip-shaped irregularities in the coated layers, not only by preventing foreign particles in the coating liquids from being entrapped on a doctor edge surface, but also by preventing the boundary surface between the upper layer and the lower layer from being adversely disturbed. Each of a first doctor edge and a second doctor edge has an arc-shaped sectional contour. An imaginary straight line $L_1$ tangentially extends along the doctor edge surfaces of the first and second doctor edges. With a position where the straight line $L_1$ intersects a perpendicular line extending upward of an upstream end of the second doctor edge designated by an intersection D, a distance t between the upstream end B and the intersection D is within the range of 5 $\mu m \leqq t \leqq 30$ $\mu m$.

4 Claims, 1 Drawing Sheet

METHOD AND APPARATUS FOR SIMULTANEOUSLY APPLYING A MULTI-LAYERED COATING AT HIGH SPEEDS

BACKGROUND OF THE INVENTION

The present invention relates generally to a coating method and a coating apparatus. More particularly, the present invention relates to a method and an apparatus for simultaneously and uniformly applying plural coating liquids onto a flexible support using an extrusion type coating head to form a laminated structure.

Generally, a conventional method for coating a moving strip-like flexible support (hereinafter referred to simply as a web) with a coating liquid such as a magnetic coating liquid or the like has been hitherto practiced by employing, e.g., an extrusion type coating apparatus, a curtain flow type coating apparatus, a doctor blade type coating apparatus, or a slide coat type coating apparatus. Among the aforementioned conventional coating methods, a coating method employing an extrusion type coating apparatus makes it possible to uniformly coat a web with a coating liquid while forming a thin layer on the web. For this reason, the foregoing coating method has been put in practical use in various applications (See, for example, Japanese Patent Publication No. 1-46186, Japanese Patent Laid-Open Publication No. 60-238179 and Japanese Patent Laid-Open Publication No. 2-265672).

However, the extrusion type coating apparatus has problems in that good coating results can practically be attained only within narrow ranges of coating conditions, and, moreover, desired coating results cannot be achieved when the coating liquid has high viscosity, the coating liquid is coated on a web in such a manner as to form a thin film thereon, or coating is performed at a high speed.

Moreover, as the transport speed of the web increases, there arises a problem in that the quantity of air entrapped in the space between the web and a coating head rapidly increases, causing the film thickness to become irregular due to the entrapment of air bubbles in the coated film.

To obviate the foregoing problems, the coating head can be configured such that the liquid pressure at the outlet of the slit of the coating head is increased to prevent air from being entrapped between the coating head and the web, or the surface of a doctor edge can be smoothed to prevent stripe-like irregularities from appearing on the coated web due to the presence of foreign particles entrapped on the top of the doctor edge.

In another approach, an extrusion type coating apparatus is employed which includes a doctor edge surface a part of which projects from a tangential line at the downstream end of a back edge surface so as to prevent a part of the web from being cut at the downstream end of the back edge surface. Such an arrangement is disclosed in Japanese Patent Laid-Open Publication Nos. 1-184072, 1-210072, 1-288364 and 2-251265.

Recently, as magnetic recording media have increasingly been formed with multiple layers and recorded at high density, it has become necessary to coat a magnetic layer on a web in a small thickness. In the circumstances mentioned above, it has been more strongly required that the coating liquid be coated on the web at a higher speed for the purpose of improving productivity. In addition, as properties of the magnetic material have been improved, oxide-based magnetic powder and barium ferrite based magnetic material, each exhibiting a high $S_{BET}$ value, have been increasingly used. On the other hand, as a result of development efforts for recording a magnetic recording medium at a high density, it has become possible to coat a web with a magnetic coating liquid having high viscosity.

However, when a web is coated with a coating liquid at a coating rate of 10 cc/m$^2$ or less employing an extrusion type coating unit wherein coating with coating liquids is simultaneously achieved at a high speed to form a laminated structure composed of an upper layer and a lower layer, there arises a problem in that stripe-shaped irregularities frequently appear in the coated layer. Another problem is that it sometimes becomes impossible to form the upper layer by coating.

To determine the causes of the aforementioned problems, the inventors have conducted a variety of experiments, as a result of which the following facts were found.

First, it is assumed that an imaginary straight line extends tangentially along the doctor edge surface of the coating head and another edge surface located on the upstream side of the former (back edge surface or doctor edge surface located upstream of the former) and a perpendicular line extends upward of the upstream end of the doctor edge surface. It is further assumed that the distance of the upstream end of the doctor edge surface from an intersection where the perpendicular line intersects the straight line is designated by t. When the distance t is small, foreign particles in the coating liquid are entrapped at the upstream end of the doctor edge surface, resulting in stripe-shaped irregularities frequently appearing on the coated layer. On the contrary, when the distance t is large, as coating liquids are simultaneously coated on the web to form a laminated structure, a boundary surface between both the upper and lower layers is adversely disturbed, whereby the upper layer cannot practically be coated on the web at a coating rate of 10 cc/m$^2$ or less.

SUMMARY OF THE INVENTION

The present invention has been made in consideration of the aforementioned problems, and thus an object of the invention resides in providing a coating method and a coating apparatus, each of which assures that an upper layer and a lower layer each of composed of a thin film, can be simultaneously coated on a web to form a laminated structure without the appearance of stripe-shaped irregularities. Thus, not only are foreign particles prevented from being entrapped on the doctor edge surface, but also a boundary surface between the upper layer and the lower layer is prevented from being adversely disturbed.

To accomplish the above and other objects, according to one aspect of the present invention, there is provided a method for simultaneously coating a plurality of layers on a web while forming a laminated structure by continuously extruding coating liquids from the forwardmost ends of a plurality of slots onto a web which continuously runs along a back edge surface and a doctor edge surface, wherein the method is characterized in that the doctor edge surface for forming at least a coated layer other than the lowermost layer has an arc-shaped sectional contour, and in that the coating liquids are simultaneously coated on the web by employing an extrusion type coating apparatus which is constructed in such a manner that, assuming that a distance defined by an upstream end of the doctor edge surface and a straight line is designated by t and the straight line tangentially extends along the doctor edge surface and another edge surface located upstream of the doctor edge surface, the distance t is within the range of 5 $\mu m \leqq t \leqq 30$ $\mu m$.

In addition, according to another aspect of the present invention, there is provided an extrusion type simultaneous laminated layer coating apparatus for simultaneously coating a plurality of layers on a web while forming a laminated structure by continuously extruding coating liquids from the forwardmost ends of a plurality of slots onto the web which continuously runs along a back edge surface and a doctor edge surface, wherein the apparatus is characterized in that the doctor edge surface for forming at least a coated layer other than the lowermost layer has an arc-shaped sectional contour and in that, assuming that a distance defined by an upstream end of the doctor edge surface and a straight line is designated by t and the straight line tangentially extends along the doctor edge surface and another edge surface located upstream of the doctor edge surface, the distance t is within the range of 5 $\mu m \leqq t \leqq 30$ $\mu m$.

As used herein, the upstream end and the downstream end of the back edge surface and the similar ends of the doctor edge surface are included within the meaning of "edge surface."

DESCRIPTION OF THE PREFERRED EMBODIMENTS

The present invention will now be described in detail hereinafter with reference to the accompanying drawings, which schematically illustrates a coating apparatus constructed in accordance with a preferred embodiment of the present invention.

Figure 1:
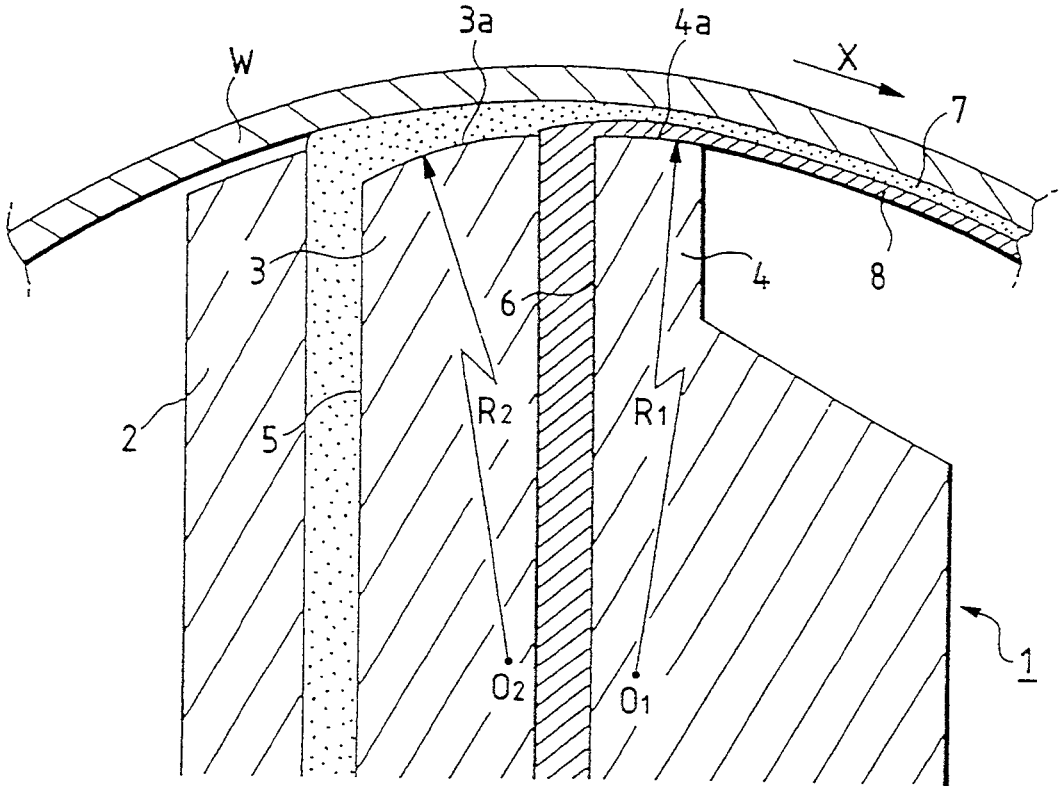
FIG. 1 is a fragmentary cross-sectional view of an extrusion type simultaneous laminated layer coating head constructed in accordance with a preferred embodiment of the present invention.
Figure 2:
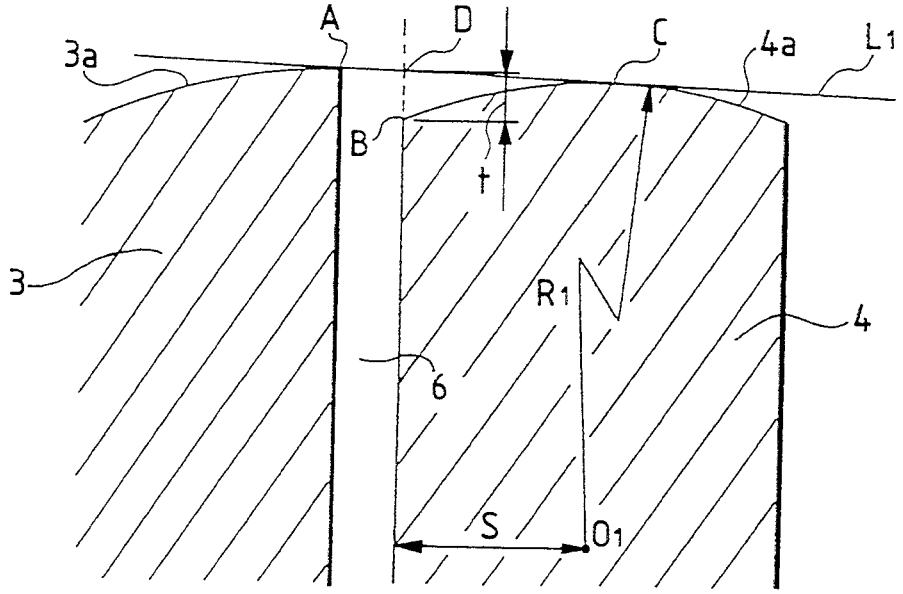
FIG. 2 is an enlarged fragmentary cross-sectional view of the extrusion type simultaneous laminated layer coating head shown in FIG. 1, particularly illustrating a contour at the forwardmost end part of the same.

FIGS. 1 and 2 illustrate in fragmentary cross-sectional views an extrusion type simultaneous laminated layer coating head 1 employable for the coating apparatus of the present invention. FIG. 1 is a fragmentary cross-sectional view of the coating head 1, particularly illustrating the coating state, and FIG. 2 is an enlarged fragmentary cross-sectional view of the coating head 1, particularly illustrating the contour of the forwardmost end part of the same.

As shown in FIG. 1, the coating head 1 is composed of a black edge portion 2, a first doctor edge portion 3, a second doctor edge portion 4, a first slot portion 5, and a second slot portion 6. As a web W is conveyed at a constant speed in the direction indicated by an arrow X, a coating liquid 7 for forming a lower layer and a coating layer 8 for forming an upper layer are simultaneously coated on the web W with a constant thickness to form a laminated structure.

The first slot portion 5 is communicated with a pocket (not shown) formed in the main body of the coating head 1 and extending in the direction of width of the web W so as to supply the coating liquid 7 therefrom, while the second slot portion 6 is communicated with another pocket (not shown) formed in a similar manner in the main body of the coating head 1 so as to supply the coating liquid 8 therefrom. Each of the slot portions 5 and 6 has the form of a comparatively narrow flow path which extends through the main body of the coating head 1 from the corresponding pocket toward the web W with the same width as that of the respective openings while extending in the direction of width of the web W in the same manner as the pocket. The length of the opening as measured in the direction of width of the web W is substantially equal to the coating width.

The back edge portion 2 includes an edge surface which is located upstream from an outlet of the slot portion 5 (as seen in the opposite direction to the direction indicated by the arrow X) and opposite to the web W.

The first doctor edge portion 3 is located downstream of the outlet of the slot portion 5. An edge surface 3*a* of the first doctor edge 3 located opposite to the web W has an arc-shaped sectional contour having a radius of curvature $R_2$.

The second doctor edge portion 4 is located downstream of the outlet of the slot portion 6. An edge surface 4*a* of the second doctor edge 4 located opposite to the web W has an arc-shaped sectional contour having a radius of curvature $R_1$. As shown in FIG. 2, an imaginary straight line $L_1$ tangentially extends along the edge surface 3*a* of the first doctor edge portion 3 and the edge surface 4*a* of the second doctor edge portion 4, and a perpendicular line extending upward of the upstream end B of the edge surface 4*a* intersects the foregoing straight line $L_1$ at an intersection D. The edge surface 4*a* of the second doctor portion 4 is contoured such that the distance t between the upstream end B and the intersection D is within the range of 5 $\mu m \leqq 30$ $\mu m$.

As shown in FIG. 2, which is an enlarged fragmentary cross-sectional view of the coating head 1, the straight line $L_1$ contacts not only the edge surface 3*a* at a downstream end A but also the edge surface 4*a* at a contact point C so that it serves as a tangential line extending past the edge surface 4*a* via the downstream end A. Otherwise, the straight line $L_1$ serves as a common tangential line extending along the edge surface 3*a* and the edge surface 4*a* depending on the contour of the first doctor edge portion 3.

The distance t can be adjusted within the above range by changing the height and/or positional relationship between the first doctor edge portion 3 and the second doctor edge portion 4. Otherwise, the distance t can be adjusted by changing the position of the center of curvature $O_1$ of the edge surface 4*a* of the second doctor edge 4. The distance t can also be adjusted using a combination of the above two techniques. Thus, it is possible to adequately adjust the distance t depending on the contour and the dimensions of the coating head.

If the distance t on the coating head 1 is set to 5 $\mu m$ or more, foreign particles in the two coating liquids are prevented from being are entrapped at the upstream end B of the edge surface 4*a* of the second doctor edge portion 4. In addition, if the distance t on the coating head 1 is set to 30 $\mu m$ or less, disturbance of the flow of the coating liquid 7 and the coating liquid 8 in the boundary surface between the lower layer and the upper layer is prevented. Consequently, the appearance of stripe-shaped irregularities in the coated layer due to the entrapment of foreign particles on the edge surface 4a of the second doctor edge portion 4 can reliably be prevented, enabling coating of the upper thin film-shaped coated layer to be achieved at a coating rate of 10 cc/m$^2$.

A high molecular film formed of polyethylene terephthalate, a paper sheet, or a metallic sheet are noted as typical webs employable for carrying out the present invention.

A preferred embodiment of the present invention has been described above with respect to a coating apparatus for simultaneously coating two layers onto a web to form a laminated structure. However, the present invention is not limited only to two layers, and it should of course be understood that the present invention may equally be applied to a coating apparatus for simultaneously coating three or more layers on a web to form a laminated structure.

As is apparent from the above description, the present invention provide a method for simultaneously coating a plurality of layers on a web while forming a laminated structure by continuously extruding coating liquids from the forwardmost ends of a plurality of slots onto a web which continuously runs along a back edge surface and a doctor edge surface, wherein the method is characterized in that the doctor edge surface for forming at least a coated layer other than the lowermost layer has an arc-shaped sectional contour, and in that the coating liquids are simultaneously coated on the web using an extrusion type coating apparatus which is constructed in such a manner that, assuming that a distance defined by an upstream end of the doctor edge surface and a straight line is designated by t and the straight line tangentially extends along the doctor edge surface and another edge surface located upstream of the doctor edge surface, the distance t is within the range of 5 $\mu$m$\leqq$t$\leqq$30 $\mu$m.

Specifically, if the distance t is set to 5 $\mu$m or more, entrapment of foreign particles in the two coating liquids at the upstream end of the doctor edge surface is prevented. In addition, if the distance t is set to 30 $\mu$m or less, disturbance of the flow of the coating liquids in the boundary surface between adjacent coated layers is prevented.

Consequently, the present invention provides a coating method and a coating apparatus which assure that an upper layer and a lower layer each composed of a thin film can simultaneously be coated on a web without the appearance of stripe-shaped irregularities on the web while forming a laminated structure.

To clarify the advantageous effects of the present invention, examples thereof will be described below (but it should of course be understood that the present invention should not be limited only to these examples).

A coating liquid 7 for a lower layer and a coating liquid 8 for an upper layer, each having a composition as noted below, were simultaneously coated on a web to form a laminated structure under coating conditions as will be described later, and thereafter, whether or not stripe-shaped irregularities appeared on the coated surface and how each coating liquid was coated on the web were observed. The results of these observations are shown in Table 1 below.

Composition of the coating liquid (7) for the lower layer

| | |
|---|---|
| carbon black (average particle size: 250 $\mu$m) | 200 parts by weight |
| polyurethane (Nipporan-7304 produced by Nippon Polyurethane Co., Ltd.) | 80 parts by weight |
| phenoxy resin (PKH-1) (produced by Union Carbide Inc.) | 30 parts by weight |
| oleic acid copper | 1 part by weight |
| methyl ethyl ketone | 500 parts by weight |

Composition of the coating liquid (8) for the upper layer

| | |
|---|---|
| magnetic iron oxide containing cobalt ($S_{BET}$ value: 35 m$^2$/g) | 100 parts by weight |
| polyurethane resin (Nipporan-2304 produced by Nippon Polyurethane Co., Ltd.) | 8 parts by weight |
| nitrocellulose | 10 parts by weight |
| polyisocyanate | 8 parts by weight |
| $Cr_2O_3$ | 2 parts by weight |
| carbon black (average particle size: 20 $\mu$m) | 2 parts by weight |
| stearic acid | 1 part by weight |
| stearic acid butyl | 1 part by weight |
| methyl ethyl ketone | 300 parts by weight |

Coating conditions

The coating liquid 7 and the coating liquid 8 were simultaneously coated on a web made of polyethylene terephthalate having a thickness of 14 $\mu$m to form a laminated structure under conditions wherein the coating speed was set to 400 m/min, the coating width was set to 500 mm, the tension on the coated part was set to 10 kgf/500 mm width, and the coating rate was set to 15.0 cc/m$^2$ and 5.0 cc/m$^2$.

A number of coating heads based on the extrusion type simultaneous laminated layer coating head 1 shown in FIG. 1 but in which the second doctor edge 4 was variously changed were fabricated. It should be noted that the radius of curvature $R_2$ of the first doctor edge 3 was set to 2 mm.

Referring to Table 1, the "center offset of second doctor edge" represents a distance S measured between the center of curvature $O_1$ of the edge surface 4a on the second doctor edge portion 4 and a perpendicular line extending downward of the upstream end B of the edge surface 4a, as shown in FIG. 2, when the curvature center $O_1$ was dislocated to the downstream side, and the term "differential height on edge" represents a differential height as measured at the top of the second doctor edge 4 relative to the top of the first doctor edge 3.

Referring to Table 1 again, o marks in the column "evaluation of stripe-shaped irregularities" represent that coating was excellently achieved, i.e., coating was achieved without the appearance of any stripe-shaped irregularities, Δ marks in the same column represent that slight stripe-shaped irregularities were observed on the web, and X marks in the same column represent that significant stripe-shaped irregularities were observed on the web. In addition, o marks in the column "properties of thin film" represent that splitting and other irregularities were not observed on the coated layer, a marks in the same column represent that irregularities were observed on the coated layer, and X marks in the same column represent that coating could not be performed due to the occurrence of splitting on the coated layer.

TABLE 1

| Sample No. | Radius of Curvature $R_1$ of second doctor edge | Center offset of second doctor edge | Differential height of edge | Distance | Evaluation of stripe-shaped irregularities | Property of thin layer |
|---|---|---|---|---|---|---|
| 1 | 3 | 0.0 | 0 | 0.0 | X | ○ |
| 2 | | | −10 | 1.2 | X | ○ |
| 3 | | | −30 | 7.6 | Δ | ○ |
| 4 | | | −50 | 16.5 | ○ | ○ |
| 5 | | | −70 | 26.8 | ○ | Δ |
| 6 | | 0.15 | 0 | 2.6 | X | ○ |
| 7 | | | −10 | 7.9 | ○ | ○ |
| 8 | | | −30 | 14.7 | ○ | ○ |
| 9 | | | −50 | 24.9 | ○ | ○ |
| 10 | | | −70 | 36.1 | ○ | X |
| 11 | 5 | 0.0 | −10 | 1.8 | X | ○ |
| 12 | | | −25 | 7.7 | Δ | ○ |
| 13 | | 0.1 | −10 | 3.9 | X | ○ |
| 14 | | | −25 | 10.7 | ○ | ○ |
| 15 | 2 | 0.0 | −40 | 9.4 | ○Δ | ○ |
| 16 | | | −90 | 31.6 | ○ | XΔ |
| 17 | | 0.2 | −40 | 23.3 | ○ | ○ |
| 18 | | | −90 | 49.7 | ○ | X |

As is apparent from Table 1, it has been found that when the distance t between the upstream end B of the second doctor edge portion 4 and the intersection D is within the range of 5 $\mu m \leqq t \leqq 30$ $\mu m$, more preferably, within the range of 10 $\mu m \leqq t \leqq 30$ $\mu m$, coating can be achieved at a high speed without the appearance of stripe-shaped irregularities in an upper layer composed of a thin film formed at a coating rate of 10 $cc/m^2$.

What is claimed is:

1. A method for simultaneously coating a plurality of layers of coating liquid onto a running web to form a laminated structure comprising the step of continuously extruding said coating liquids from forwardmost ends of a plurality of slots in a coating head onto said web, said web continuously running along a back edge surface and a doctor edge surface of said coating head, wherein a doctor edge surface of said coating head for forming a coated layer other than a lowermost coated layer on said web has an arc-shaped sectional contour, and, with a distance between an intersection and an upstream end of said doctor edge designated by t and said intersection coinciding with a position where a straight line tangentially extending along said doctor edge surface and another edge surface located upstream of and adjacent to said doctor edge surface intersects a perpendicular line extending upward of said upstream end of said doctor edge surface, said distance t is within a range of 5 $\mu m \leqq t \leqq 30$ $\mu m$.

2. The method of claim 1, wherein t is in a range of 10 $\mu m \leqq t \leqq 30$ $\mu m$.

3. An apparatus for simultaneously coating a plurality of layers of coating liquid onto a running web to form a laminated structure by continuously extruding said coating liquids, comprising, a plurality of slots in a coating head for extruding therethrough said coating liquids from forwardmost end of said plurality of slots onto said web, said web continuously running along a back edge surface and a doctor edge surface of said coating head, wherein a doctor edge surface of said coating head for forming a coated layer other than a lowermost coated layer on said web has an arc-shaped sectional contour, and, with a distance between an intersection and an upstream end of said doctor edge designated by t and said intersection coinciding with a position where a straight line tangentially extending along said doctor edge surface and another edge surface located upstream of and adjacent to said doctor edge surface intersects a perpendicular line extending upward of said upstream end of said doctor edge surface, said distance t is within a range of 5 $\mu m \leqq t \leqq 30$ $\mu m$.

4. The apparatus of claim 3, wherein t is in a range of 10 $\mu m \leqq t \leqq 30$ $\mu m$.

* * * * *